United States Patent [19]

Prechtel

[11] B 4,014,738

[45] Mar. 29, 1977

[54] SIFTING DRUM PAPER MACHINE WHEREIN THE DILUENT WATER IS CONTROLLED

[75] Inventor: Klaus Prechtel, Heidenheim, Germany

[73] Assignee: J. M. Voith GmbH, Heidenheim (Brenz), Germany

[22] Filed: Sept. 18, 1974

[21] Appl. No.: 507,166

[44] Published under the second Trial Voluntary Protest Program on April 13, 1976 as document No. B 507,166.

[30] Foreign Application Priority Data

Sept. 20, 1973 Germany ..... 2347369

[52] U.S. Cl. ..... 162/258; 162/252; 162/259; 162/263; 162/297; 162/317

[51] Int. Cl.[2] ..... D21F 1/06; D21F 1/08

[58] Field of Search ..... 162/252, 258, 259, 297, 162/263, 317, 340, 363

[56] References Cited

UNITED STATES PATENTS 3,455,780 7/1969 Hazard, Jr. et al. ..... 162/364

3,631,982 1/1974 Lejeune ..... 162/340 X 3,741,865 6/1973 Lejeune ..... 162/317

OTHER PUBLICATIONS

Armstrong; "New Cylinder Former Designs–Necessary for Survival"; *Paper Trade Journal;* 3–15–65, pp. 43–47, 162–317.

*Primary Examiner*—S. Leon Bashore
*Assistant Examiner*—M. Steven Alvo
*Attorney, Agent, or Firm*—Herbert L. Lerner

[57] ABSTRACT

Sifting drum paper machine having a sifting drum with a pulp material inlet located at the outside thereof and suction chambers disposed in the interior thereof, includes a measurement of pressure in the vicinity of a paper web-forming part on the surface of the drum, the pressure measurements being used to control the quantity of diluent water to the supply of pulp material to the pulp material inlet in response to an adjustment value fed thereto and corresponding to the measured pressure.

2 Claims, 1 Drawing Figure

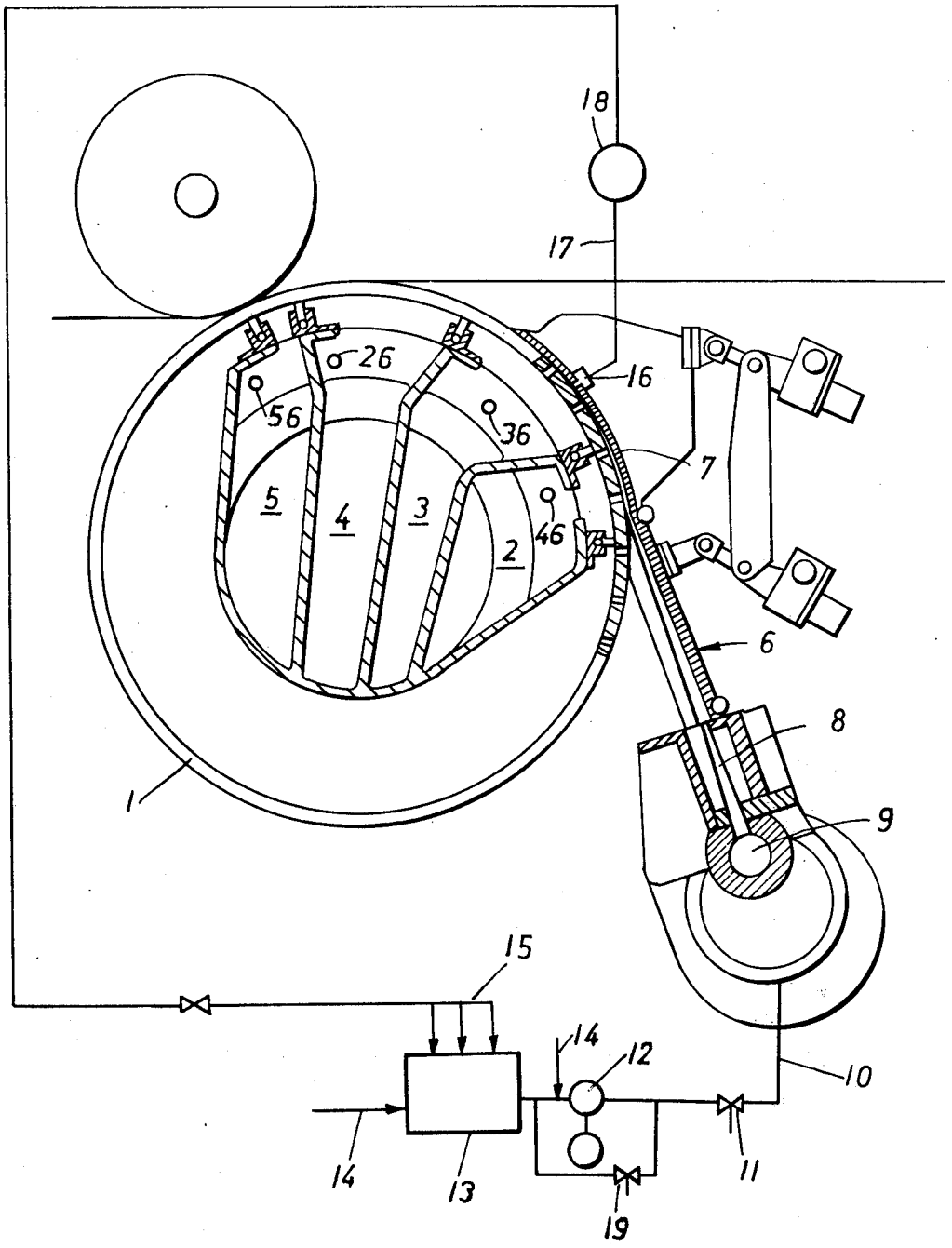
18
17
26
16
56
36
7
5
4
3
2
46
6
8
1
9
15
14
12
10
14
13
11
19

SIFTING DRUM PAPER MACHINE WHEREIN THE DILUENT WATER IS CONTROLLED

The invention relates to a sifting drum paper machine having a forward end located at the outside of the sifting drum per se, and suction chambers disposed in the interior thereof. In sifting drum paper machines of the foregoing type that are employed in practice, it is very difficult to produce a paper web with unvarying quality. The production process and the web which is formed must be monitored continuously and any irregularities that may occur must be immediately compensated for by varying the supply of suspension. This is very troublesome and costly, however.

It is accordingly an object of the invention to provide a sifting drum paper machine of the foregoing type which avoids the aforementioned disadvantages of such heretofore known machines and by which the production process is carried out predominantly automatically.

With the foregoing and other objects in view, there is provided in accordance with the invention, a sifting drum paper machine having a sifting drum with a pulp material inlet located at the outside thereof and suction disposed in the interior thereof, comprising means located in vicinity of a paper web-forming part of the machine for measuring pressure prevailing thereat, and regulating means for regulating the supply of pulp material to the pulp material inlet in response to an adjustment value fed thereto and corresponding to the measured pressure.

Since this measured pressure is primarily dependent upon the quantity of pulp material or the web thickness produced thereby and the characteristics of the pulp material (the pulp freeness, the fines content) a very good quality of the produced paper web can be attained over this measured pressure. The web quality is namely very greatly effected by variations in the pulp freeness and in the fines content thereof. By means of the invention of the instant application, such variations are automatically compensated for or balanced. In accordance with another feature of the invention a quantity of diluent water supplied to the pulp material inlet is regulatable in accordance with the measured pressure.

This regulation may be effected in an especially simplified manner and provides a trouble-free control of the paper sheet formation and thereby of the web quality as well as stable machine operation.

In accordance with further features of the invention, the pulp material inlet is formed with a rear wall, and pressure-measuring means are located on the rear wall, and in fact at an end region of the rear wall in flow direction of th pulp material supplied to the inlet, for the purpose of measuring inner pressure of the pulp material inlet.

In this regard, it has been found that the pressure measured at this location actually represents an especially advantageous control value for the production of the paper web. Obviously, the inner pressure measured at other locations of the pulp material inlet can also be employed for control or regulating purposes.

In accordance with yet another feature of the invention, the pressure-measuring location is provided in one of the suction chambers of the sifting drum per se. In this regard, it has been found to be especially advantageous to provide pressure-measuring means in the first of the suction chambers in flow direction of the pulp material that is free of the pulp material inlet, the underpressure prevailing in the first suction chamber free of the inlet serving as a measure for the web thickness and effecting the control or regulation thereof.

Other features which are considered as characteristic for the invention are set forth in the appended claims.

Although the invention is illustrated and described herein as embodied in sifting drum paper machine it is nevertheless not intended to be limited to the details shown since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic sectional view of a sifting drum paper machine according to the invention having means for regulating or controlling the supply of pulp material suspension to the pulp material inlet.

Referring now to the drawing, there is shown therein a sifting cylinder or drum 1, in the interior space of which four suction chambers 2, 3, 4 and 5 are disposed. At the outside of the sifting drum 1, there is located a pulp material inlet 6 having a rear wall 7 which completely covers the suction chamber 2 and most of the suction chamber 3. The pulp material inlet 6 is supplied with a suspension of pulp fibers through a distributor pipe 8 from a supply pipe 9 which extends over the width of the machine. The FIGURE of the drawing shows schematically how fiber suspension is fed through a supply line 10 to the supply pipe 9 to which it is connected. A control valve 11 for adjusting the flow of supplied pulp material suspension is connected in the supply line 10. A pump 12 is connected in the supply line 10 upstream of the valve 11 in flow direction of the suspension, the pump 12 being further connected to a vessel 13 in which a viscous material line 14 as well as a diluent water line 15 terminate, which are connected with the suction chambers 2, 3, 4 and 5.

A pressure element or box 16 of conventional construction such as of a bellows type, for example, is mounted in the rear wall 7 of the pulp material inlet 6 and measures the inner pressure prevailing in the inlet 6. Instead of the pressure element 16 in the rear wall 7, however, conventional pressure measuring devices 26, 36, 46 or 56 can be provided in the suction chambers 2, 3, 4 and 5, respectively. In this regard, it has been found that, of these pressure measuring devices 26, 36, 46 and 56, the device 26 in the suction chamber 4 (the first suction chamber free of the pulp material inlet 6) is most suitable. The pressure element 16 or one of the pressure measuring devices 26, 36, 46 or 56 is connected through a line 17 to a measurement amplifier or booster 18, through which the pulp material or fiber suspension supply to the inlet 6 is controllable. In addition the measurement booster or amplifier 18 is either connected to the valve 11 or to the drive motor of the pump 12 or to a control valve 19 installed in a bypass around the pump 12. It is also possible, moreover, to control the quantity of diluent water traveling through the lines 15 to the vessel 13 in dependence upon the measurement booster or amplifier 18.

I claim:

1. A sifting drum paper machine having a sifting drum with a pulp material inlet located at the outside thereof and suction chambers disposed in the interior thereof and with means for measuring pressure in vicinity of a paper web-forming part on the surface of the drum, said pressure measuring means operatively connected with means controlling the quantity of diluent water to the supply of pulp material to said pulp material inlet in accordance with said measured pressure.

2. A sifting drum paper machine according to claim 1 wherein the pulp material inlet is formed with a rear wall and said pressure-measuring means are located on said rear wall in vicinity of the end region of said rear wall downstream of the flow of pulp material supplied to said pulp material inlet.

* * * * *